US012781617B2

(12) United States Patent
Slongo et al.

(10) Patent No.: US 12,781,617 B2
(45) Date of Patent: Nov. 3, 2026

(54) CONFORMAL SPACE FILLING COILS

(71) Applicant: Halliburton Energy Services, Inc., Houston, TX (US)

(72) Inventors: Leonardo Kessler Slongo, Rio de Janeiro (BR); Joao Vicente Goncalves Rocha, Rio de Janeiro (BR); Ahmed Elsayed Fouda, Pearland, TX (US); Alexandre Henrique Brescovitt, Rio de Janeiro (BR); Andre Franco Vieira Alves Beserra, Rio de Janeiro (BR)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 162 days.

(21) Appl. No.: 18/797,295

(22) Filed: Aug. 7, 2024

(65) Prior Publication Data

US 2025/0250894 A1 Aug. 7, 2025

Related U.S. Application Data

(60) Provisional application No. 63/549,853, filed on Feb. 5, 2024.

(51) Int. Cl.
*E21B 47/00* (2012.01)
*E21B 47/13* (2012.01)

(52) U.S. Cl.
CPC ..... *E21B 47/006* (2020.05); *E21B 47/13* (2020.05)

(58) Field of Classification Search
CPC ..... E21B 47/13; E21B 47/006
See application file for complete search history.

(56) References Cited

U.S. PATENT DOCUMENTS 6,344,739 B1 2/2002 Hardy et al.
7,598,742 B2 * 10/2009 Synder, Jr. ..... G01V 3/28 324/333

(Continued)

FOREIGN PATENT DOCUMENTS

CN 105911134 A 8/2016
CN 108872374 A 11/2018

(Continued)

OTHER PUBLICATIONS

English abstract of CN 105911134A; retrieved from www.espacenet.com on Aug. 7, 2024.

(Continued)

*Primary Examiner* — Eman A Alkafawi
*Assistant Examiner* — Suresh K Rajaputra
(74) *Attorney, Agent, or Firm* — NOVAK DRUCE CARROLL LLP

(57) ABSTRACT

The disclosure introduces various arrangements of inductive elements that may be incorporated into an electromagnetic tool. These tools enable a process that may be referred to as through-tubing azimuthal defect evaluation. A set of inductive elements included in such a tool may be arranged in a pattern that allows the tool to collect data from areas 360 degrees around the tool. Inductive element designs may include geometries that optimize the use of available space for conductors used to make an inductive element. Multiple elements may be placed in a circular arrangement to fit inside a set of tubing capable of being deployed in a wellbore. An arrangement of wire coils may be classified as being optimal when they fit within a trapezoidal form factor of an inductive element.

20 Claims, 11 Drawing Sheets

(56) References Cited

U.S. PATENT DOCUMENTS

| | | | | |
|---|---|---|---|---|
| 9,803,466 | B2 | 10/2017 | Donderici | |
| 10,082,017 | B2 | 9/2018 | Yu et al. | |
| 10,190,404 | B2 | 1/2019 | Khalah Amineh et al. | |
| 10,670,562 | B2 | 6/2020 | Donderici et al. | |
| 2008/0265893 | A1 | 10/2008 | Snyder et al. | |
| 2016/0160629 | A1* | 6/2016 | Donderici | G01N 27/9046 324/238 |
| 2016/0168974 | A1* | 6/2016 | Donderici | E21B 47/007 |
| 2016/0187523 | A1* | 6/2016 | Sanmartin | E21B 47/006 324/339 |
| 2016/0370166 | A1 | 12/2016 | Yang et al. | |
| 2016/0370488 | A1 | 12/2016 | San Martin et al. | |
| 2019/0219723 | A1* | 7/2019 | Yonley | G01N 27/9046 |
| 2022/0282964 | A1 | 9/2022 | Linder et al. | |

FOREIGN PATENT DOCUMENTS

| | | | |
|---|---|---|---|
| CN | 109060938 | A | 12/2018 |
| CN | 212228822 | U | 12/2020 |
| CN | 112986379 | A | 6/2021 |
| EP | 2052436 | B1 | 10/2014 |
| WO | 2013188384 | A2 | 12/2013 |

OTHER PUBLICATIONS

English abstract of CN108872374A; retrieved from www.espacenet.com on Aug. 7, 2024.

English abstract of CN 109060938A; retrieved from www.espacenet.com on Aug. 7, 2024.

English abstract of CN112986379A; retrieved from www.espacenet.com on Aug. 7, 2024.

English abstract of CN212228822U; retrieved from https://patents.google.com/patent/CN212228822U/en?oq=CN212228822.

International Search Report & Written Opinion; PCT Application No. PCT/US2024/043396; mailed Nov. 26, 2024.

* cited by examiner

CONFORMAL SPACE FILLING COILS

CROSS-REFERENCE TO RELATED APPLICATIONS

This application claims priority benefit to U.S. provisional patent application No. 63/549,853, filed Feb. 5, 2024, and entitled "CONFORMAL SPACE FILLING COILS," the disclosure of which is incorporated by reference herein.

TECHNICAL FIELD

The present disclosure is generally directed to wellbore sensing systems. More specifically the present disclosure is directed to improved sensors capable of being deployed in a wellbore.

BACKGROUND

When managing oil and gas drilling and production environments (e.g., wellbores, etc.) and performing operations in the oil and gas drilling and production environments, it is important to obtain measurements and other sensor data and details regarding pipes, tubing, or casings included in a wellbore. Furthermore, details associated with Earth formations and conditions in the vicinity of a wellbore may also be important to monitor. Such data may be used to understand downhole conditions and help manage the wellbore and associated operations. Sensor data can be evaluated to identify the integrity of a wellbore or wellbore components yet often constraints of the wellbore environment limit the accuracy of data sensed by sensors.

BRIEF DESCRIPTION OF THE DRAWINGS

In order to describe the manner in which the features and advantages of this disclosure can be obtained, a more particular description is provided with reference to specific implementations thereof which are illustrated in the appended drawings. Understanding that these drawings depict only exemplary implementations of the disclosure and are not therefore to be considered to be limiting of its scope, the principles herein are described and explained with additional specificity and detail through the use of the accompanying drawings in which.

DETAILED DESCRIPTION

Figure 1A:
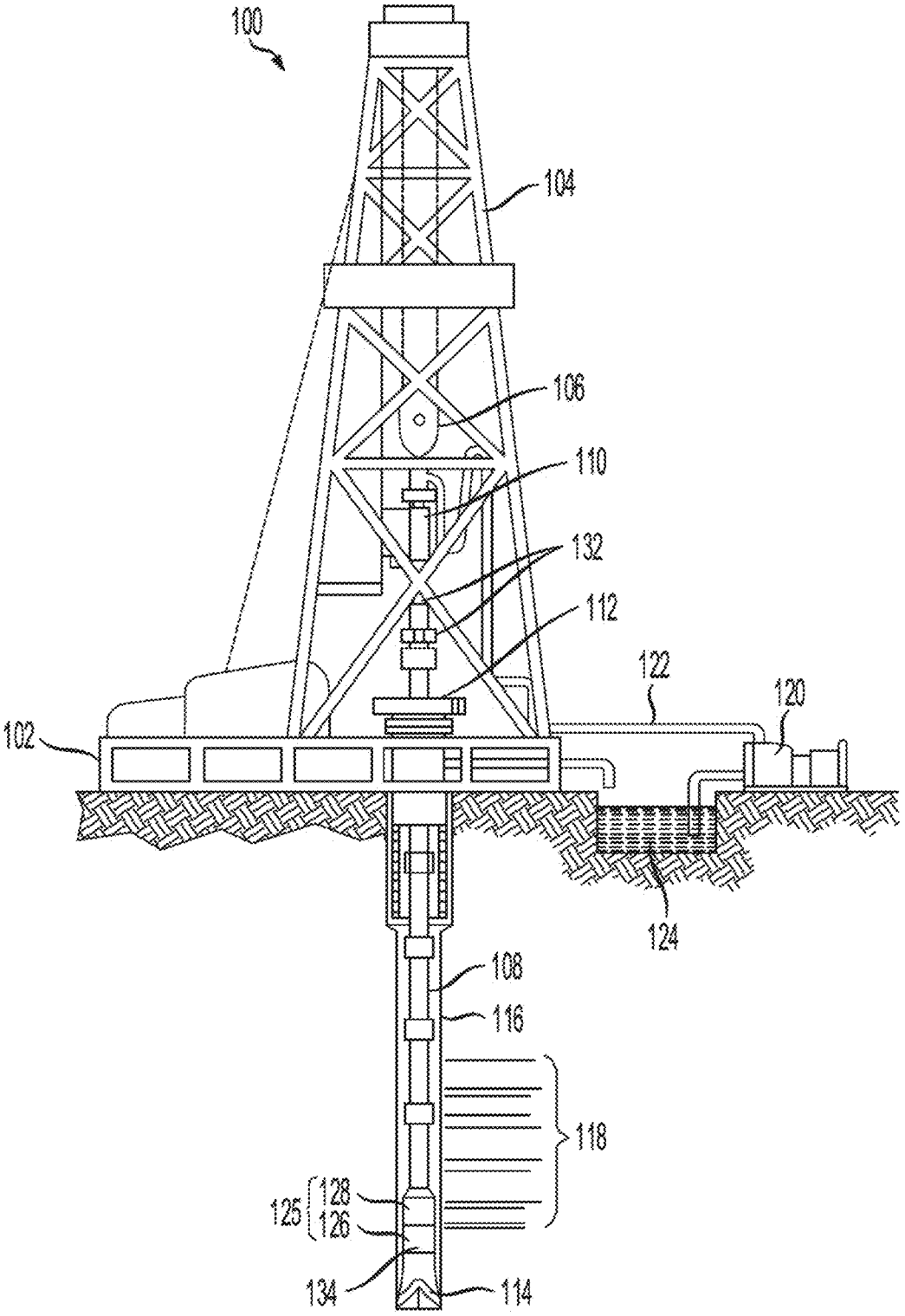
FIG. 1A is a schematic diagram of an example logging while drilling wellbore operating environment, in accordance with various aspects of the subject technology.

Various aspects of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the methods and apparatus described herein. However, it will be understood by those of ordinary skill in the art that the methods and apparatus described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the present disclosure.

Assessments relating to the quality of the construction of a wellbore requires deploying equipment in a wellbore during one or more phases of wellbore development. In instances when a wellbore project is focused on extracting hydrocarbons from the Earth, the phases of such a wellbore project may include a drilling phase, a sleeving phase, a cementing phase, and a production phase. A given type of wellbore project may include additional or different phases, such as a hydraulic fracturing phase or a carbon sequestration phase.

Described herein are systems, apparatuses, processes (also referred to as methods), and computer-readable media (collectively referred to as "systems and techniques") for improving an accuracy of determinations made using data sensed in a wellbore.

The disclosure introduces various arrangements of inductive elements that may be incorporated into the design of an electromagnetic tool. Tools consistent with the present disclosure have an azimuthal sensitivity that extends beyond a structure (e.g., a pipe, a tube, or a casing) that is being evaluated. As such, these tools are considered to have a deep azimuthal sensitivity useful for evaluating defects in pipes, tubes, casings, or other structures that may be present in a wellbore. These tools enable a process that may be referred to as through-tubing azimuthal defect evaluation. A set of inductive elements included in such a tool may be arranged in a circular or circumferential pattern that allows the tool to collect data from areas 360 degrees around the tool. Inductive element designs may include geometries that optimize the use of available space for electrical current conductor (copper winding) and magnetic field conductor (e.g., a ferromagnetic core). Multiple elements may be placed in a circular arrangement to fit inside a set of tubing capable of being deployed in a wellbore. An arrangement of wire coils may be classified as being optimal when they fit within a trapezoidal form factor of an inductive element. This classification may also indicate that an additional thickness of wire added to a wire coil would cause the inductive element to be larger than the trapezoidal form factor.

Examples of two different types of cores that may be included in an inductive sensor design are: 1) Ferromagnetic core to focus the magnetic field lines to pass through the interior of the inductive sensor, increasing its sensibility. 2) Polymeric core to minimize the inductive sensor influence over the magnetic field lines and minimally disturb their natural path. The core choice may depend on the analysis to be made and operational needs. Such ferromagnetic cores may include laminations of steel strips and a number of the steel strips associated with the trapezoidal from factor is identified by a core length divided by a thickness of the steel strips.

The conformal space filling coils may include multiple inductive elements arranged to act as an electromagnetic-through-tubing-tool that has a plurality of inductive elements azimuthally distributed to transmit and/or sense electromagnetic fields in a radial direction (orthogonal to a central axis of the tool or a tube within which the tool is deployed). Inductive elements of such a tool may include coils that have an axis perpendicular to the tools radial direction. These inductive elements may also be arranged with their axes parallel to a center line of the tool. This design also enables the use of the inductive elements as a magnetic field source/generator. One or more circular arrangements (e.g., a crown of sensors/generators) of inductive elements may be used to increase the tool's depth of investigation and vertical resolution. When using at least two crowns (two sets of circumferential inductive elements), different combinations of simultaneously sourcing elements point the magnetic field at a desired direction to form a beam of electromagnetic energy or beamform transmitted electromagnetic signals. Alternatively, only one indicative element may be used to transmit one or more electromagnetic signal(s) at a time. Signals transmitted by one or more inductive elements may be of any type, including yet not limited to sine waves, signals generated by one or more alternating on-off current pulses, or modulated signals.

A wellbore casing includes many different segments that are commonly attached to each other by screwing to pieces of pipe together to form a metallic tube that is deployed in the Earth. Once deployed, the casing is commonly cemented in place and the cement is allowed to cure. Ideally, cured cement should uniformly adhere external surfaces of the casing to internal surfaces of a wellbore where the casing is deployed. In practice, such a cementing operation may never be perfect, yet may be adequate to accomplish a task (e.g., hydrocarbon extraction). To determine whether a wellbore has been manufactured to a quality level that is acceptable for a given task, characteristics of the wellbore must meet at least some standard or threshold requirements associated with that given task. For this reason, measurements must be made and data from these measurements must be analyzed such that the characteristics of the wellbore may be quantified.

Tubing located in a wellbore or other wellbore structures may rust/corrode or otherwise degrade overtime. For this reason, sensors may have to be deployed to validate that sets of tubing or other structures associated with the wellbore meet quality metrics. As such, devices used to collect data regarding the quality of tubing or casing materials may have to be deployed throughout the lifespan of a wellbore.

FIG. 1A is a schematic diagram of an example logging while drilling wellbore operating environment, in accordance with various aspects of the subject technology. The drilling arrangement shown in FIG. 1A provides an example of a logging-while-drilling (commonly abbreviated as LWD) configuration in a wellbore drilling scenario 100. The LWD configuration can incorporate sensors (e.g., EM sensors, seismic sensors, gravity sensor, image sensors, etc.) that can acquire formation data, such as characteristics of the formation, components of the formation, etc. For example, the drilling arrangement shown in FIG. 1A can be used to gather formation data through an electromagnetic imager tool (not shown) as part of logging the wellbore using the electromagnetic imager tool. The drilling arrangement of FIG. 1A also exemplifies what is referred to as Measurement While Drilling (commonly abbreviated as MWD) which utilizes sensors to acquire data from which the wellbore's path and position in three-dimensional space can be determined. FIG. 1A shows a drilling platform 102 equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, it creates a wellbore 116 that passes through various subterranean formations 118. A pump 120 circulates drilling fluid through a supply pipe 122 to top drive 110, down through the interior of drill string 108 and out orifices in drill bit 114 into the wellbore. The drilling fluid returns to the surface via the annulus around drill string 108, and into a retention pit 124. The drilling fluid transports cuttings from the wellbore 116 into the retention pit 124 and the drilling fluid's presence in the annulus aids in maintaining the integrity of the wellbore 116. Various materials can be used for drilling fluid, including oil-based fluids and water-based fluids.

Logging tools 126 can be integrated into the bottom-hole assembly 125 near the drill bit 114. As drill bit 114 extends into the wellbore 116 through the formations 118 and as the drill string 108 is pulled out of the wellbore 116, logging tools 126 collect measurements relating to various formation properties as well as the orientation of the tool and various other drilling conditions. The logging tool 126 can be applicable tools for collecting measurements in a drilling scenario, such as the electromagnetic imager tools described herein. Each of the logging tools 126 may include one or more tool components spaced apart from each other and communicatively coupled by one or more wires and/or other communication arrangement. The logging tools 126 may also include one or more computing devices communicatively coupled with one or more of the tool components. The one or more computing devices may be configured to control or monitor performance of the tool, process logging data, and/or carry out one or more aspects of the methods and processes of the present disclosure.

The bottom-hole assembly 125 may also include a telemetry sub 128 to transfer measurement data to a surface receiver 132 and to receive commands from the surface. In at least some cases, the telemetry sub 128 communicates with a surface receiver 132 by wireless signal transmission (e.g., using mud pulse telemetry, EM telemetry, or acoustic telemetry). In other cases, one or more of the logging tools 126 may communicate with a surface receiver 132 by a wire, such as wired drill pipe. In some instances, the telemetry sub 128 does not communicate with the surface, but rather stores logging data for later retrieval at the surface when the logging assembly is recovered. In at least some cases, one or more of the logging tools 126 may receive electrical power from a wire that extends to the surface, including wires extending through a wired drill pipe. In other cases, power is provided from one or more batteries or via power generated downhole.

Collar 134 is a frequent component of a drill string 108 and generally resembles a very thick-walled cylindrical pipe, typically with threaded ends and a hollow core for the conveyance of drilling fluid. Multiple collars 134 can be included in the drill string 108 and are constructed and intended to be heavy to apply weight on the drill bit 114 to assist the drilling process. Because of the thickness of the collar's wall, pocket-type cutouts or other type recesses can be provided into the collar's wall without negatively impacting the integrity (strength, rigidity and the like) of the collar as a component of the drill string 108.

Figure 1B:
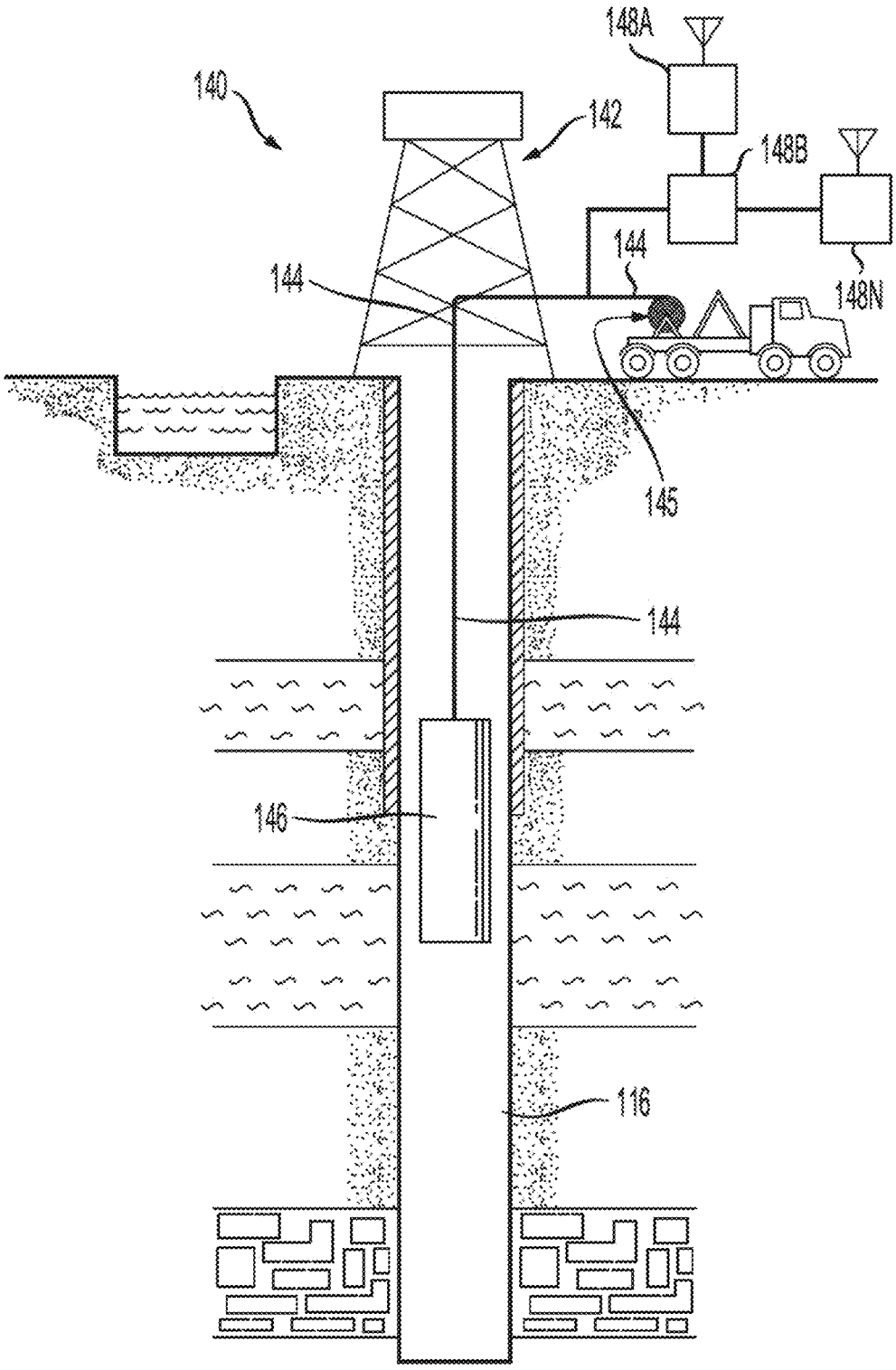
FIG. 1B is a schematic diagram of an example downhole environment having tubulars, in accordance with various aspects of the subject technology.

FIG. 1B is a schematic diagram of an example downhole environment having tubulars, in accordance with various aspects of the subject technology. System 140 may be used to conduct downhole measurements, for example, after at least a portion of a wellbore has been drilled and the drill string removed from the well. An electromagnetic imager tool (not shown) can be operated in example system 140 shown in FIG. 1B to log the wellbore. A downhole tool is shown having a tool body 146 in order to carry out logging and/or other operations. Fin certain instances, instead of using the drill string 108 of FIG. 1A to lower the downhole tool, which can contain sensors and/or other instrumentation for detecting and logging nearby characteristics and conditions of the wellbore 116 and surrounding formations, a wireline conveyance 144 can be used. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars. The downhole tool can include an applicable tool for collecting measurements in a drilling scenario, such as the electromagnetic imager tools described herein.

The illustrated wireline conveyance 144 provides power and support for the tool, as well as enabling communication between data processors 148A-N on the surface. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more of the processors 148A-N, which can include local and/or remote processors. The processors 148A-N can be integrated as part of an applicable computing system, such as the computing device architectures described herein. Moreover, power can be supplied via the wireline conveyance 144 to meet power requirements of the tool. For slickline or coiled tubing configurations, power can be supplied downhole with a battery or via a downhole generator.

Figure 2:
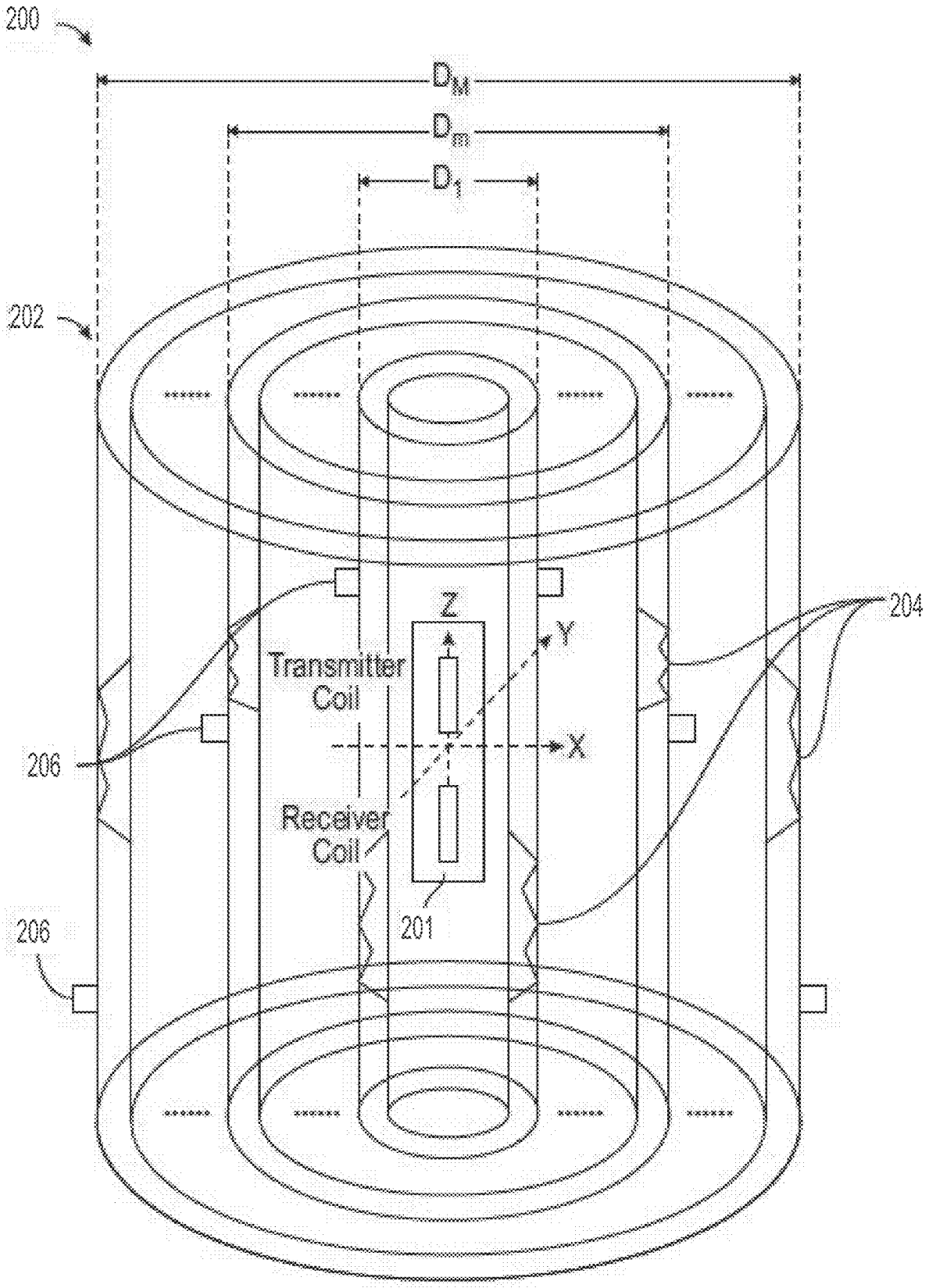
FIG. 2 illustrates a schematic representation of an environment including an electromagnetic pipe inspection tool disposed in a nested pipe configuration, in accordance with various aspects of the subject technology.

FIG. 2 illustrates a schematic representation of an environment 200 including an electromagnetic pipe inspection tool 201 disposed in a nested pipe configuration 202. The nested pipe configuration 202 can exist downhole. As follows, the electromagnetic pipe inspection tool 201 can be disposed downhole to gather measurements for characterizing the pipes in the nested pipe configuration 202 according to the technology described herein. The nested pipe configuration 202 includes concentric pipes. The electromagnetic pipe inspection tool 201 deployed inside the nested pipe configuration 202 can gather measurements for characterizing anomalies that exist in the nested pipe configuration 202, e.g. corrosions 204 and collars 206. Specifically, as the tool 201 moves within the nested pipe configuration 202, one or more transmitters are excited, and corresponding electromagnetic signals are received at one or more receivers and are recorded as part of downhole measurements gathered by the electromagnetic pipe inspection tool 201. Specifically, eddy currents can be generated in the areas surrounding the tool 201. The eddy currents can generate electromagnetic fields that can be measured by the receivers, e.g. through a voltage that is generated at the receivers. In turn, the voltages at the receivers can be used in characterizing the area surrounding the tool 201.

The nested pipe configuration 202 shown in FIG. 2 is merely an example pipe configuration, and in various embodiments the electromagnetic pipe inspection tool 201 can be operated in different pipe configurations for characterizing features of the pipes.

The tools described herein can have various orientations of transmitter and receiver elements, e.g. coils, in both transmitter stations and receiver stations. A transmitter station can include one or more transmitter elements, e.g. coils, that are capable of transmitting an electromagnetic signal as part of the operation of an electromagnetic pipe inspection tool. A receiver station can include one or more receiver elements, e.g. coils, that are capable of receiving an electromagnetic signal as part of operation of an electromagnetic pipe inspection tool. The transmitter elements of the transmitter stations described herein can function to also receive electromagnetic signals, thereby operating as a transceiver. Similarly, the receiver elements of the receiver stations described herein can function to also transmit electromagnetic signals, thereby operating as a transceiver.

The various orientations of transmitter and receiver elements described herein can include orientations that are along or otherwise parallel to the z axis shown in FIG. 2, herein referred to as z-orientation or z-orientated. The orientations of transmitter and receiver elements described herein can also include orientations that are the angles between the projection of a vector in the xy-plane and planes parallel the xy-plane shown in FIG. 2, herein referred to as phi-orientation or phi-orientated. Further, the orientations of transmit and receiver elements described herein can also include orientations that are along projections of a vector in the xy-plane and planes parallel the xy-plane shown in FIG.

2, herein referred to as radial-orientation or radially-orientated. These orientations can be used to make measurements along an axial depth of a tool disposed in one or more well tubulars. These orientations can also be used to make measurements at a varying azimuth in relation to a tool disposed in one or more well tubulars. Further, these orientations can be used to make measurements along a radial depth in relation to a tool disposed in one or more well tubulars.

Figure 3A:
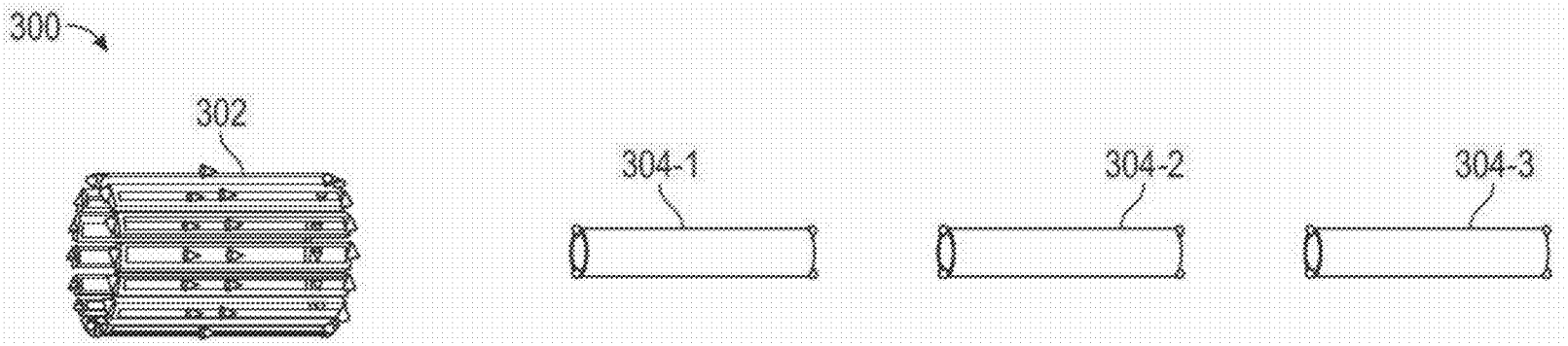
FIG. 3A illustrates a side view of a configuration of transmitter stations and receiver stations of a pipe inspection tool, in accordance with various aspects of the subject technology.
Figure 3B:
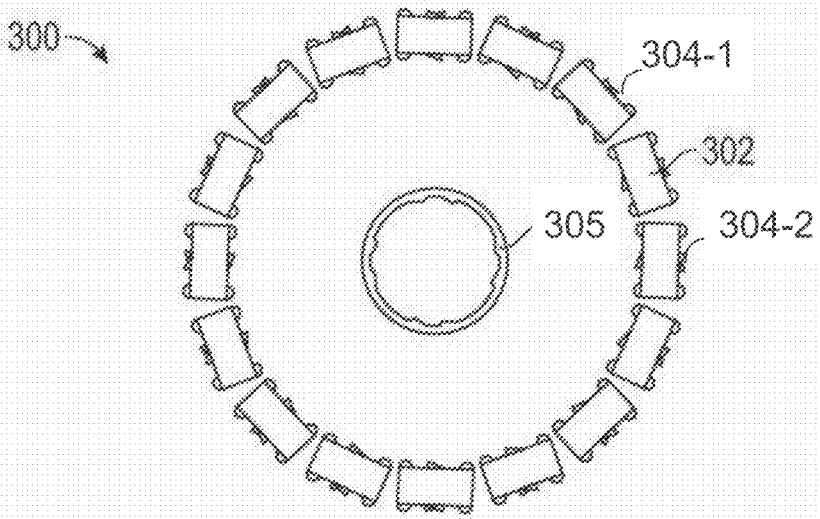
FIG. 3B illustrates a top view of the configuration of the transmitter stations and receiver stations of the pipe inspection tool that is shown in FIG. 3A, in accordance with various aspects of the subject technology.

The disclosure now continues with a discussion of technology for overcoming the previously described deficiencies of inspecting tubulars through electromagnetic pipe inspection tools. Specifically, FIG. 3A illustrates a side view of a configuration 300 of transmitter stations and receiver stations of a pipe inspection tool. FIG. 3B illustrates a top view of the configuration 300 of the transmitter stations (inductive elements actively transmitting EM signals) and receiver stations (inductive elements actively receiving EM signals) of the pipe inspection tool that is shown in FIG. 3A.

In FIGS. 3A and 3B, the pipe inspection tool includes a receiver station 302 and a first transmitter station 304-1, a second transmitter station 304-2, and a third transmitter station 304-3 (herein referred to as "transmitter stations 304"). While one receiver station and three transmitter stations are shown in the configuration 300, the pipe inspection tool can include an applicable number of stations.

As shown in FIGS. 3A and 3B, the tool may include multiple transmitter/receiver coils. The tool may also include a central portion 305 around which multiple radially orientated receiver/transmitter coils may be placed. The multiple orientated transmitters can be located at different axial locations to achieve different depths of investigation along either or both an axial depth and a radial depth, e.g., shallow, medium and deep. The multiple radially orientated coils can be located at the same axial location but different azimuthal angles to achieve 360-degree coverage around the tool during a pipe inspection operation.

Figure 4:
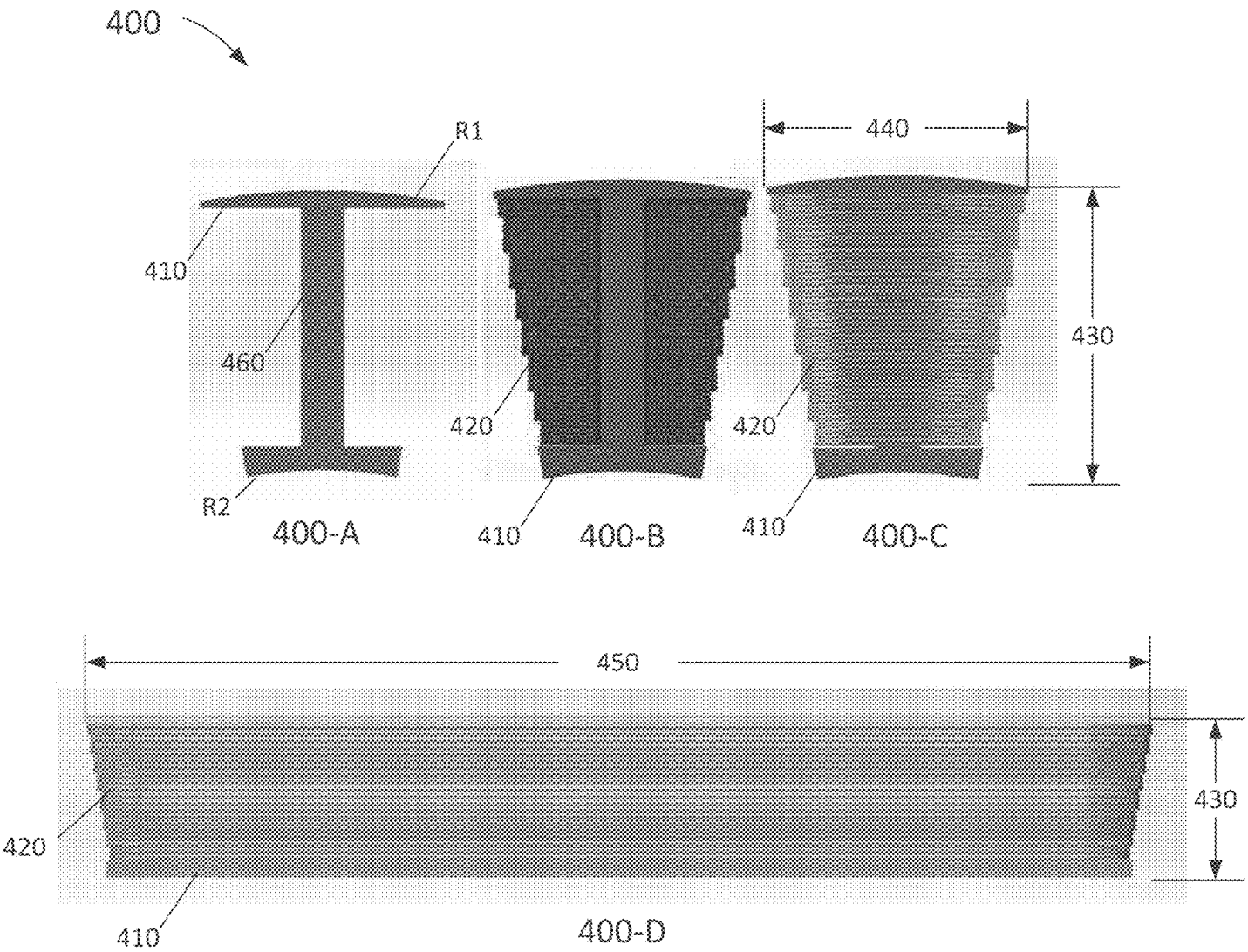
FIG. 4 illustrates parts of an inductive element that may be one of many inductive elements included in a sensor, in accordance with various aspects of the subject technology.

FIG. 4 illustrates parts of an inductive element that may be one of many inductive elements included in a sensor consistent with the present disclosure. FIG. 4 includes images 400-A, 400-B, 400-C, and 400D that show different views the parts of the inductive element 400 of the figure. Image 400-A shows an end view of a core (410) around which a wire (420) may be wound. While image 400-A includes only core 410, images 400-B, 400-C, and 400-D show core 410 around which wire 420 is wound. Image 400-B shows an end view inductive element 400 of FIG. 4 in cross-section. Image 400-C shows an end view of inductive element 400 where wraps of the wire 420 of are wound around a central portion 460 of core 410.

Images 400-A, 400-B, 400-C, and 400-D illustrate conformal coils that are inductive elements with a specific geometry that allows coils to be wound in a trapezoidal shape where there is a non-uniform turn density along the axis of the coil to maximize the number of turns of wire that can be include in an inductive element that has a trapezoidal shape. Exemplary core structures can be made of polymeric or a ferromagnetic material. When using a polymeric core, the function may be to provide the trapezoidal shape coils with minimally disturbance of the magnetic field lines. When a ferromagnetic core is used, magnetic fields may be forced to pass within the coils. A plurality of these inductive elements may be referred to as r-directional coils located at the same axial location but different azimuthal angles to achieve 360-degree coverage of a pipe inspection process.

Image 400-D shows a side view of inductive element 400. In this instance, the inductive element 400 has a length 450 that is much larger than the height 430 or maximum width 440 of inductive element 400. This means that a central portion 460 of core 410 may have the shape of an ellipse. Since the coil formed by the wraps of wire 420 have a trapezoidal shape, a number of wraps the wire 420 around the core's central portion 460 vary. In such an instance, a top portion of core 410 will have more wire wraps than a bottom portion of core 410. The trapezoidal shape of inductive element 400, differences between a number of wire wraps at the bottom versus the top of the inductive element, and parameters of core 410 may affect the shape of a magnetic field generated by inductive element 400. Overall performance of such a trapezoidal shaped inductive element may be a function of the gauge of wire 420, a number of wire wraps, a type of material used to make core 410, sizes of a top and/or a bottom portion of core 410, and a measure of current passed through wire 420 of inductive element 400. As mentioned above, inductive element 400 may be one inductive element of many inductive elements used in a sensor of the present disclosure.

In one instance, an inductive element may have a length of about 4.65 inches and a height dimension of 0.795 inches, where the top portion of core 410 has a first radius R1 and the bottom portion of core 410 has a second radius R2. When a plurality of inductive elements 400 are abutted side-to-side against each other in a circular configuration. This may form two concentric circles, one that has a larger circumference (that is associated with radius R1) and another that has a smaller circumference (that is associated with radius R2).

Note that the coils illustrated in images 400-B, 400-C, and 400D change diameter in what appears as a series of steps where a cross-sectional area of the coil increases over the height dimension 430 of the inductive element. As such, wire wrappings included in inductive elements of the present disclosure may fill virtually all space between two abutted inductive elements. The space that the coils fill may correspond to a form factor of a trapezoid. A procedure for manufacturing such an inductive element may include: 1. Wind wire around a first portion of a core until a lower limit of the core is reached, this lower limit may be associated with a wire thickness and a first number of wraps: 2. Wind an upper part of the core until an upper limit is reached: 3. Employ a visual and tactile lap/wrap control throughout specified areas of the inductive element, for example, from 300 wire wraps onwards. 4. Evaluate dimensions visually and tactilely every 10 laps/wraps. 5. Stop winding before the wires leave a useful window core (e.g. the trapezoidal form factor) associated with the core (e.g. the trapezoidal form factor): 6. Requirements may identify a flexibility metric of the coils and a rule may dictate that the wrappings must be retained within the useful window of the core. 6. Thin tape may be used to compress the wires. 7. In certain instances, glue, or resin or combination thereof may be applied and compressed with thin tape in a vise.

Figure 5:
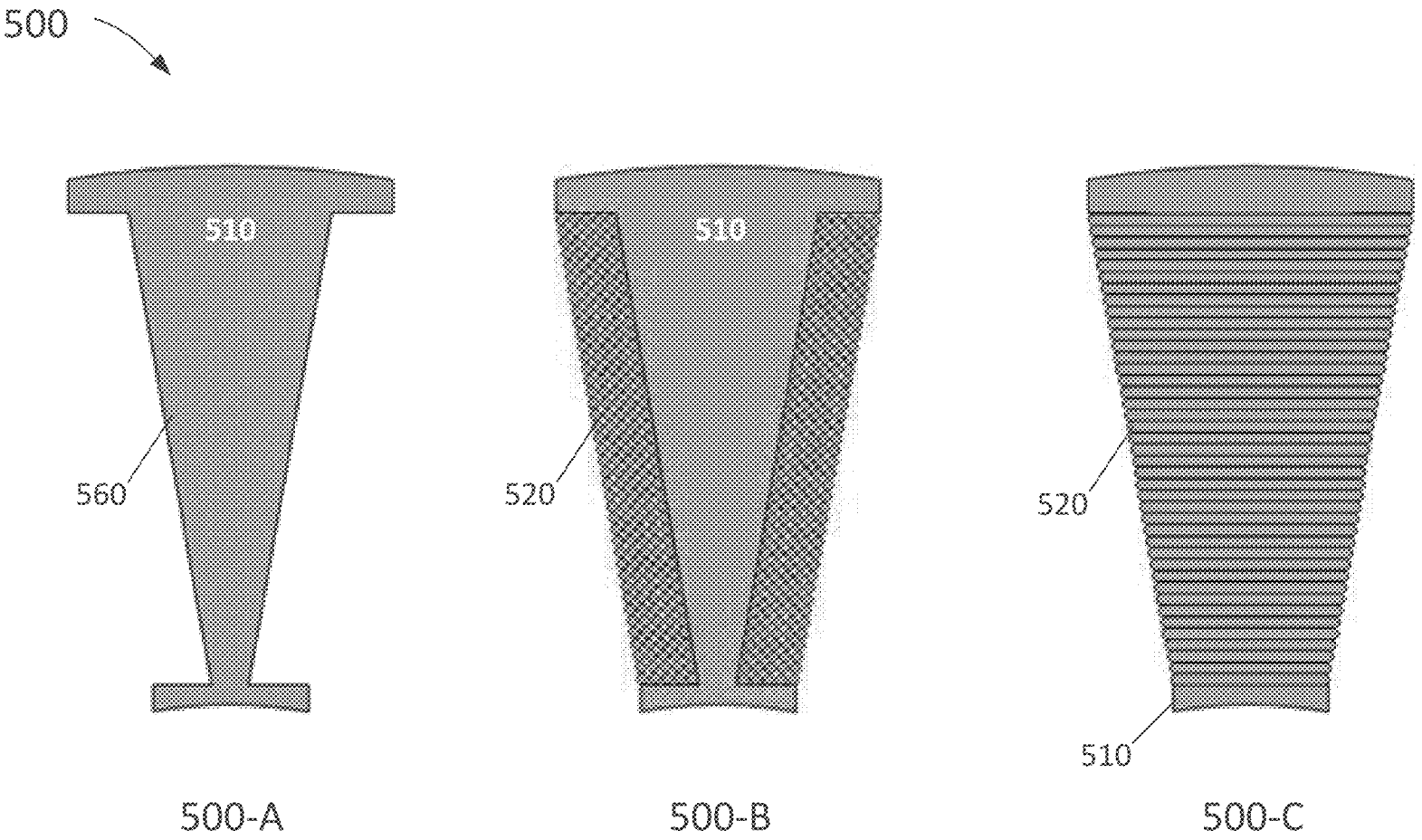
FIG. 5 illustrates a second set of parts of an inductive element that may be one of many inductive elements included in a sensor, in accordance with various aspects of the subject technology.

FIG. 5 illustrates a second set of parts of an inductive element that may be one of many inductive elements included in a sensor consistent with the present disclosure. FIG. 5 includes images 500-A, 500-B, and 500-C that show different views the parts of inductive element 500 of the figure. Image 500-A shows an end view of a core (510) around which a wire (520) may be wound. While image 500-A includes only core 510, images 500-B, and 500-C show core 510 around which wire 520 is wound. Image 500-B shows an end view inductive element 500 of FIG. 2 in cross-section. Image 500-C shows an end view of inductive element 500 where wraps of the wire 520 of are wound around a trapezoid shaped central portion 560 of core 510.

Core 510 has non-uniform trapezoidal shape and a cross section area which allow coils to be wounded around it with either uniform or non-uniform turn density. This structure may help to maximize coil cross-section near pipes, tubes, or casings that are being inspected.

Since the central portion 560 of core 510 has a trapezoidal shape, an inductive element in the shape of a trapezoid may be formed where the top portion of core 510 has the same number of wire wraps as the bottom portion of core 510 as image 500-B shows. The inductive element 400 of FIG. 4 and the inductive element 500 of FIG. 5 may have the same length, height, and width. This means that inductive element 400 of FIG. 4 and inductive element 500 of FIG. 5 may have the same "form factor" and that inductive element 400 may be interchanged when a sensing device is reconfigured.

Figure 6:
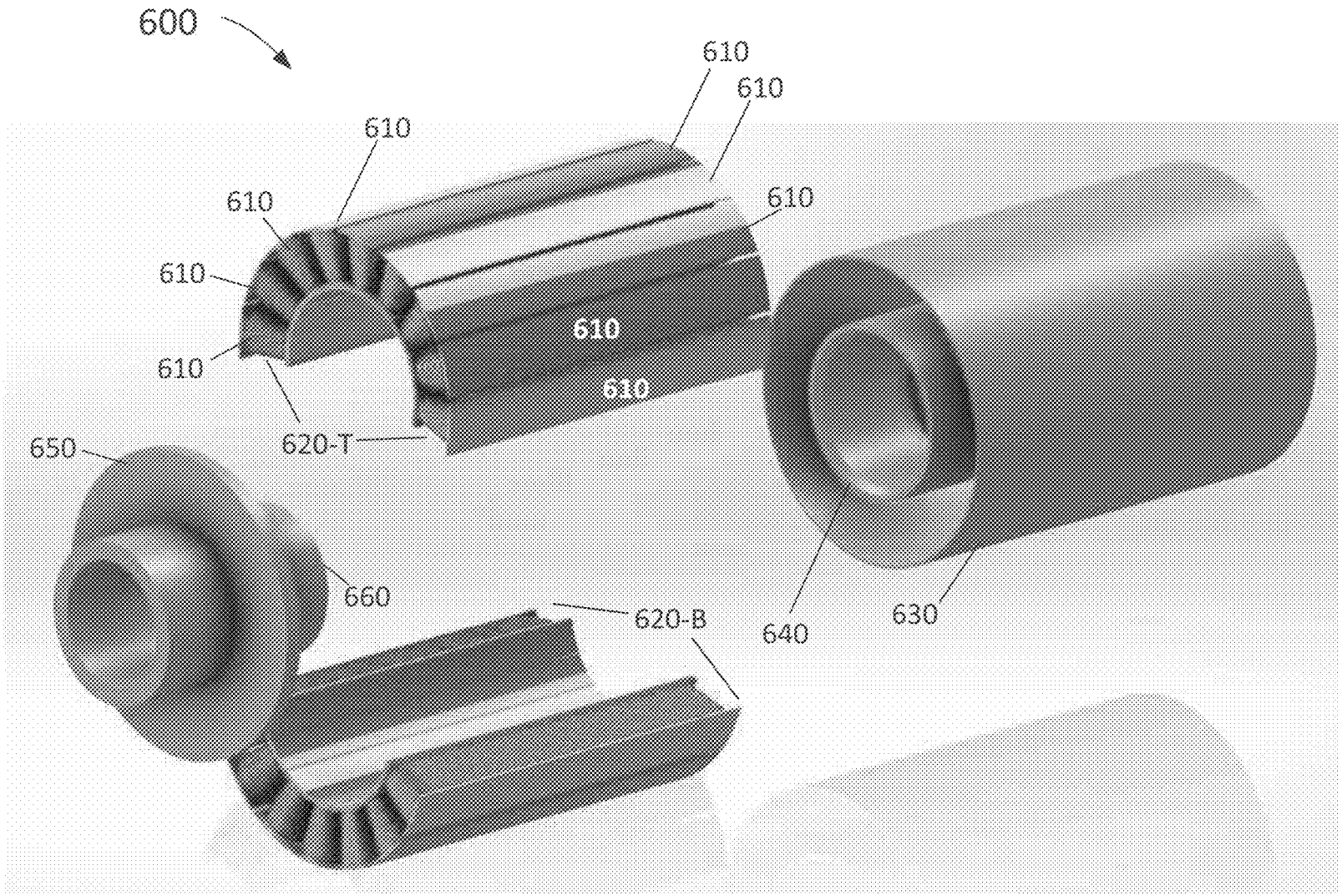
FIG. 6 illustrates parts that may be included in a sensor assembly, in accordance with various aspects of the subject technology.

FIG. 6 illustrates parts that may be included in a sensor assembly of the present disclosure. The sensor assembly 600 of FIG. 6 includes a plurality of inductive elements 610 that may be arranged in a circular shape when assembled into housing/enclosure 630. FIG. 6 illustrates a top hemispherical section 620-T and a bottom hemispherical section 620-B that each include eight inductive elements 610. Tubing or mandrel (e.g., a central cylindrical core) 640 arranged in housing 630 may be configured to receive each the inductive elements illustrated in FIG. 6. Sensor assembly 600 may also include cap 650 that attached to housing 630 where protrusion 660 of cap 650 may couple to the tubing or mandrel 640 arranged in housing 630 when sensor assembly 600 is assembled. Such an assembly may be sealed from the environment exterior to the housing and as such inductive elements 610 may be isolated from harsh environments or elements that may be located in a wellbore.

A trapezoidal design of the inductive elements maximizes use of available space while improving the sensor sensitivity, signal to noise ratio (SNR), angular resolution, and magnetic field generation. This is because shaped inductive elements may be arranged to fill all or much of the space between adjacent indicative elements when they are arranged in a circular or circumferential 360-degree arrangement where sizes of coil windings of each inductive element 610 conforms to a trapezoidal form factor. This 360-degree arrangement allows both inner and outer surfaces of the inductive element cores to form a circle in instances when adjacent inductive elements abut together.

Coils of the inductive elements may shape or help shape electromagnetic fields emitted by these inductive elements when they act as a field source and these inductive elements may receive electromagnetic energy when acting as electromagnetic field sensors. In certain instances, inductive elements may have a polymeric (or nonferromagnetic) core that minimally influences magnetic field lines. In other instances, inductive elements may have a ferromagnetic core used to focus a magnetic field to pass within coils of inductive elements.

Respective inductive elements may be configured as modules that attach to a structural central part (e.g., tubing or mandrel 640) of a modular device. Electrical contacts disposed on a mounting surface may make electrical contact with wires of an inductive element when the inductive element is attached to the mounting surface. Such a modular sensing device may be re-configured by removing a set of modules and by attaching another set of modules. This means that a device that is initially configured to use inductive elements that have a nonferromagnetic core may be reconfigured to use inductive elements that have a ferroelectric core by unplugging and replacing a set of inductive elements. By being modular, a set of inductive elements may be deployed on a mounting surface, or on or within a tube of either a first diameter or a second diameter. In one instance, adjacent inductive elements may have surfaces that abut together and, in another instance, adjacent inductive elements may have gaps between those same surfaces.

Sensor assembly 600 may include a gap between inductive elements 610 and housing/enclosure 630 such that inductive elements 610 do not physically touch housing 630. In certain instances, housing 630 may be made of non-magnetic materials (e.g., a non-magnetic metal) or materials that have a magnetic permeability less than a threshold value/measure of magnetic permeability. In other instances, housing 630 may be made of ferroelectric materials or a material that has at least a threshold value/measure of permeability. Similarly, cores around which wires are wound may be made of materials with selected magnetic permeability characteristics (e.g., non-magnetic materials—materials that have a magnetic permeability less than a threshold value/measure of magnetic permeability, ferromagnetic materials—materials that have greater than a threshold value/measure of magnetic permeability) or combinations of permeability characteristics.

Figure 7:
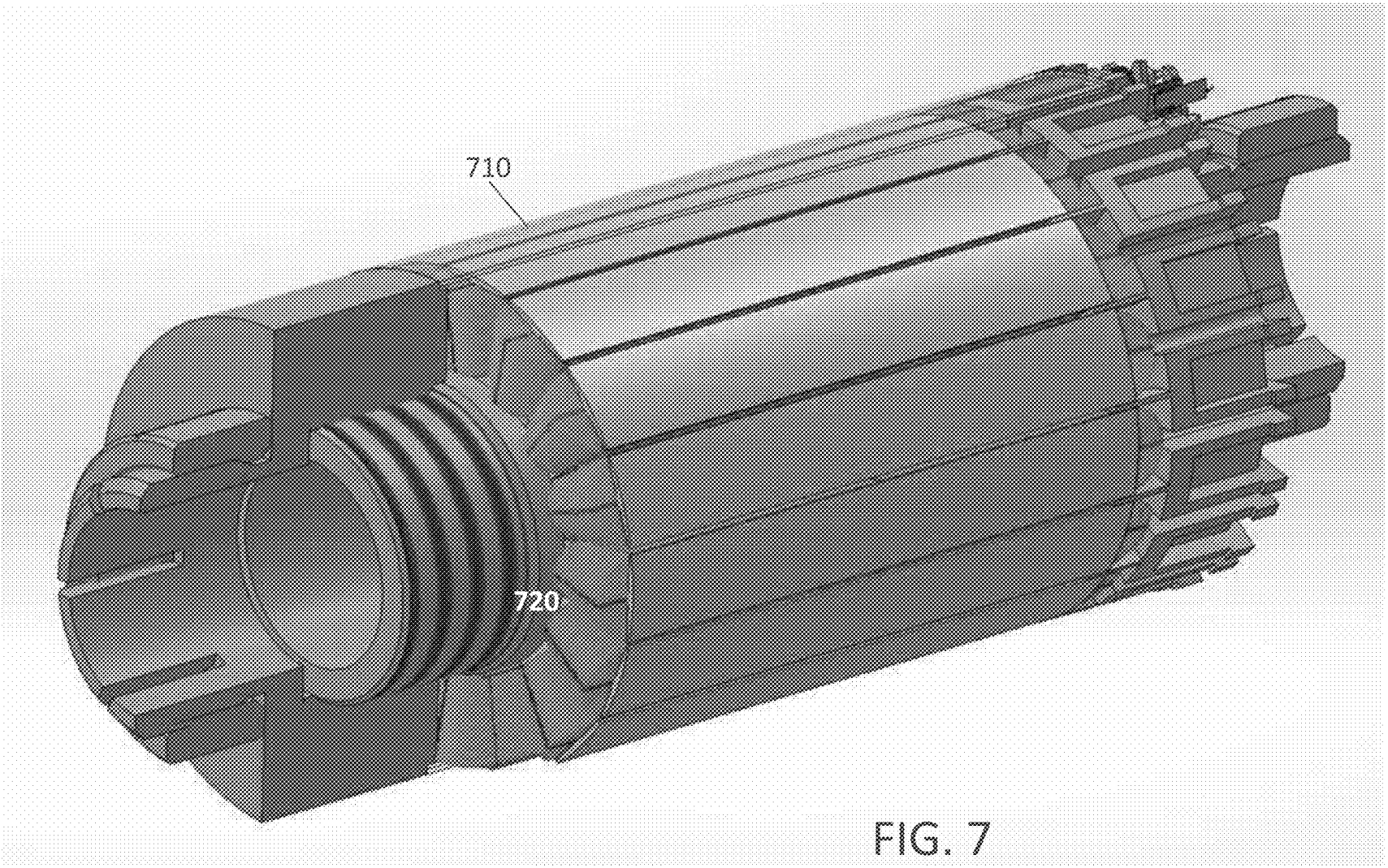
FIG. 7 illustrates semi-cross-sectional view of a sensor assembly, in accordance with various aspects of the subject technology.

FIG. 7 illustrates semi-cross-sectional view of a sensor assembly consistent with the present disclosure. In one instance, wires of each inductive element may be wrapped around a ferromagnetic core and an inductive element array 710. In such an instance the inductive elements of array 710 may be arranged around cylindrical structure 720 that is non-magnetic (e.g., a material that has a less than a threshold value/measure of magnetic permeability).

Figure 8:
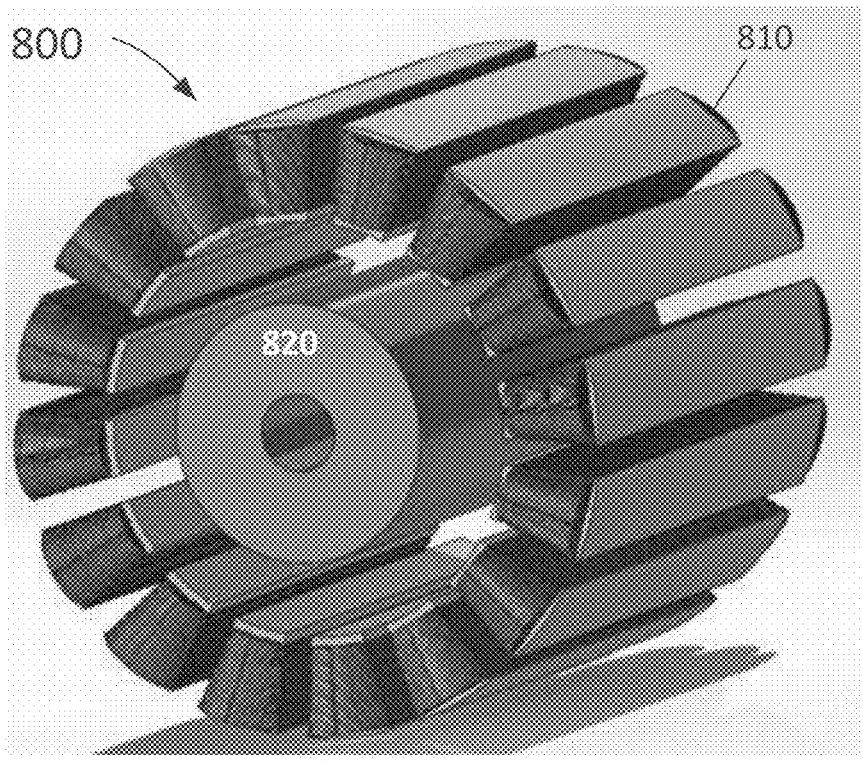
FIG. 8 illustrates two slightly different sensor assemblies where inductive elements are arranged around a cylindrical core of a specified magnetic permeability, in accordance with various aspects of the subject technology.
Figure 8:
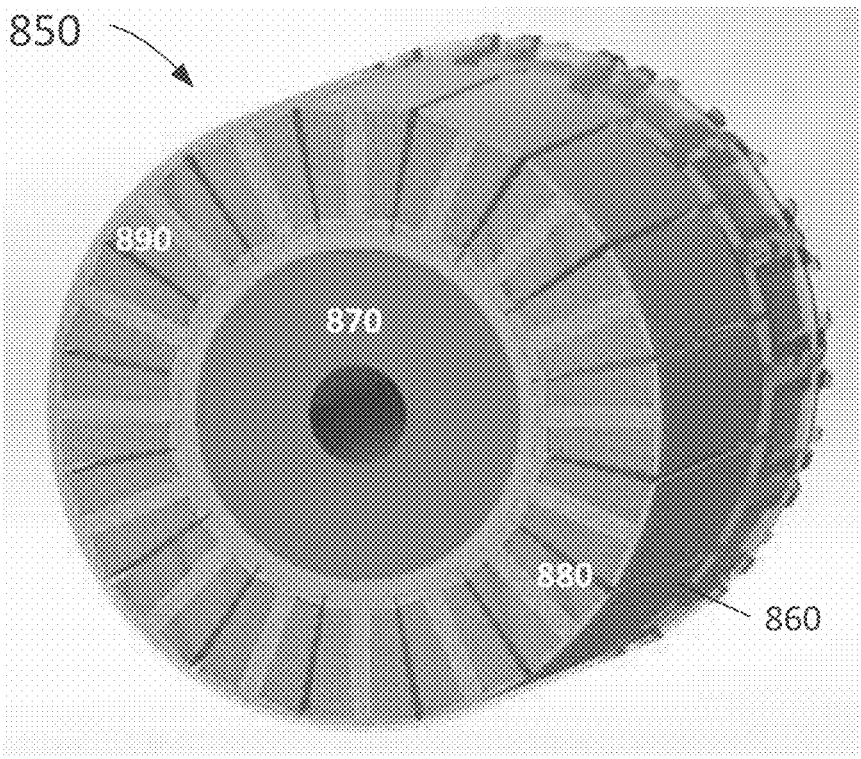

FIG. 8 illustrates two slightly different sensor assemblies where inductive elements are arranged around a cylindrical core/mandrel of a specified magnetic permeability. In one instance, cores used to make inductive elements may be made of a "ferroelectric material" and these inductive elements may be arranged in a circular inductive element array around a cylindrical core/mandrel that is also made of that ferroelectric or another ferroelectric material. FIG. 8 illustrates sensing subassembly 800 that may include array 810 of inductive elements arranged around core/mandrel 820. Inductive elements of sensing subassembly 800 may not be directly abutted to core/mandrel 820 as either this space may be a gap or may be filled with a material that fills a gap between inner ends of the inductive elements and core/mandrel 820. Spaces between respective inductive elements of array 810 may be associated with not abutting adjacent inductive elements together. Such an arrangement may be used when a set of sensing elements are deployed in a housing, enclosure, or tube that has a larger diameter than a corresponding diameter associated with abutting the inductive elements together.

FIG. 8 also illustrates subassembly 850 that may include array 860 of inductive elements arranged around core/mandrel 870. In this instance, the inductive elements may be attached to core/mandrel 870. Here again core/mandrel 870 may be made of ferroelectric material and cores of the inductive elements included in array 860 may be made of that same ferroelectric material or another ferroelectric material. Inductive elements 880 and 890 included in the sensing subassembly 850 are located on opposite sides of that sensing subassembly. Note that in subassembly 850, adjacent inductive elements are abutted to each other. This may be the case when the inductive elements are deployed in a housing, enclosure, or tube that has a smaller diameter relative to the diameter of subassembly 800.

The use of a core/mandrel made of a material that has at least a first threshold value/measure of magnetic permeability (a ferromagnetic material) may help increase the signal-to-noise ratio of a sensing device as compared to another sensing device that has a core/mandrel made of a non-ferromagnetic material (a material that has less than a second threshold value/measure of magnetic permeability). This is because magnetic fields that must propagate through the center of a sensing device to reach a particular inductive element will be attenuated before they reach that particular inductive element.

In operation, inductive elements included in a sensing device may both transmit and receive electromagnetic energy. This means that an electromagnetic field emitted by or otherwise associated with one inductive element may be received by other inductive elements. For example, when inductive element 880 emits pulses of electromagnetic energy, that energy must pass through core/mandrel 870 before it reaches inductive element 890. When core/mandrel 870 is made of a material that has ferroelectric properties, that material will absorb at least a portion of the energy directed toward inductive element 890 before it can reach inductive element 890. As such, a core/mandrel that includes a ferromagnetic material will help shield inductive elements included in a sensing apparatus from stray or undesirable electromagnetic fields, thereby increasing the SNR of the sensing apparatus. As such cores/mandrels made of materials that have at least a threshold value/measure of magnetic permeability may increase SNR based on attenuation and isolation.

Figure 9:
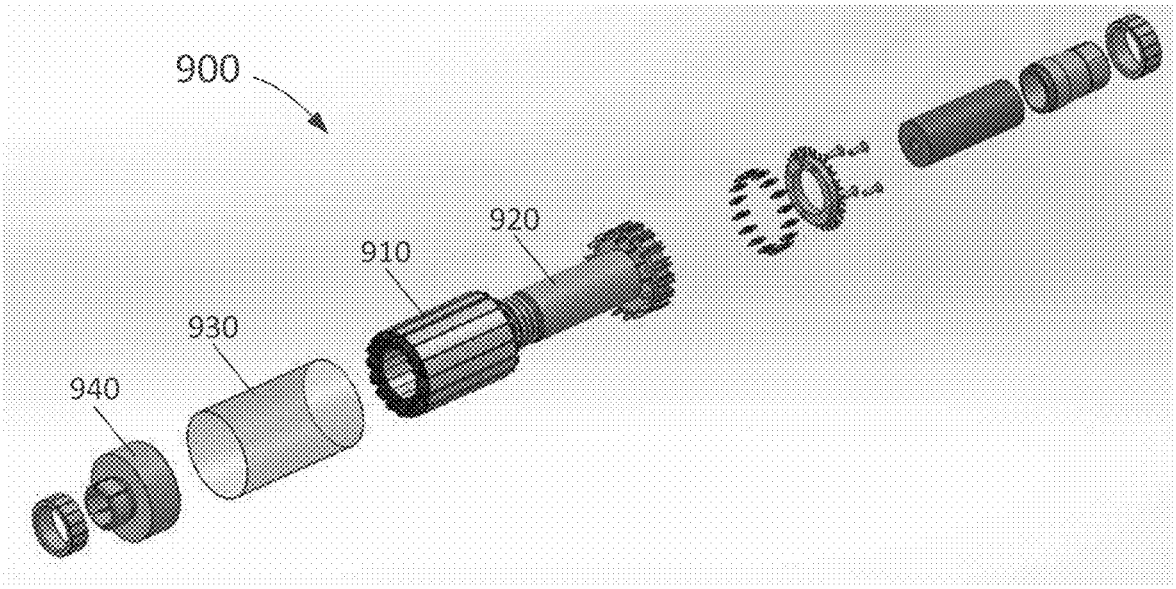
FIG. 9 illustrates two assembly drawings that show parts of a sensing apparatus that may be deployed in a wellbore, in accordance with various aspects of the subject technology.
Figure 9:
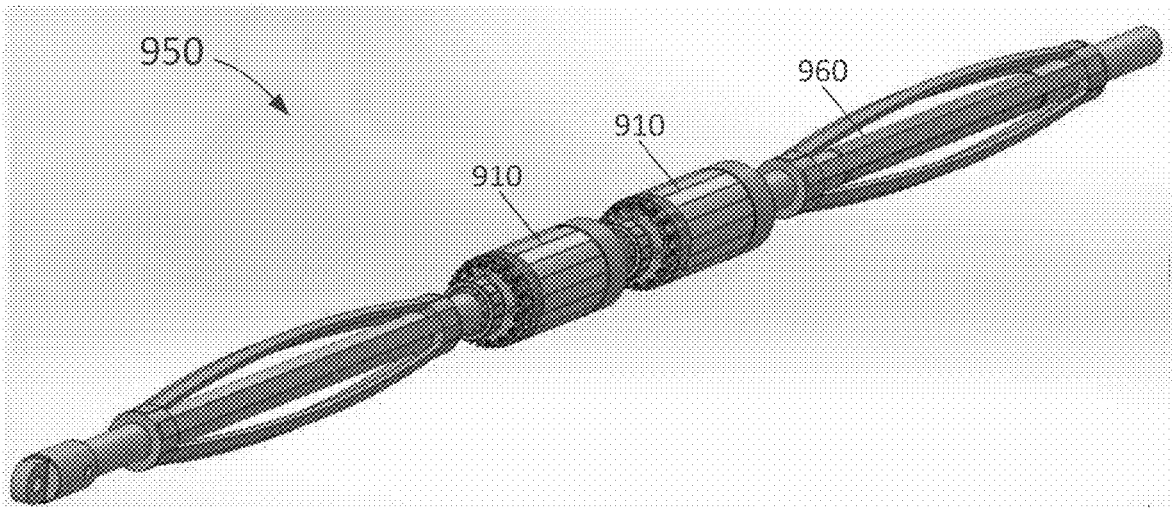

FIG. 9 illustrates two assembly drawings that show parts of a sensing apparatus that may be deployed in a wellbore. FIG. 9 includes a first assembly drawing that shows a perspective view of an inductive array being incorporated into a wellbore tool. Assembly drawing 900 includes inductive array 910, core or "mandrel" 920 that may have a cylindrical shape, housing/enclosure 930, and cap 940 that are similar to the arrays of inductive elements 610, the tubing or core/mandrel 640, the enclosure 630, and the cap 650 of FIG. 6. A center line of a tool made using the parts of assembly drawing 900 may correspond to a line that traverses along the center of core/mandrel 920, array 910, and enclosure 930.

FIG. 9 also includes a second assembly drawing 950 that shows a perspective view of a sensing assembly that includes two arrays 910 and optional transmission coil 960. In operation, transmission coil 960 may emit pulses of electromagnetic (EM) energy or other EM signals when the sensing assembly is deployed in a wellbore. The EM energy emitted by transmission coil 960 may propagate into, induce eddy currents, and/or reflect off sections of tubing and/or casings in vicinity of the sensing device. At this time, the inductive elements in arrays 910 may receive signals when portions of the transmitted EM energy induced by eddy currents passes through the inductive elements in arrays 910. These signals or data associated with these signals may be provided to a computer or other circuitry that may identify whether structures of the tubing and/or casings are fit for service.

In certain instances, individual inductive elements included in an array may transmit EM pulses and other inductive elements in that array or in a nearby array may receive signals associated with those transmissions. Multiple inductive elements may transmit EM signals in a sequence and/or steady-state waveforms, with a single or combined frequencies, where amplitudes and phases of transmitted EM pulses may be altered to form beams of emitted EM energy in a beamforming process. Here again, an overall performance of trapezoidal shaped inductive element may be a function of the gauge of wire, a number of wire wraps, a type of material used to make core, sizes of a top and/or a bottom portion of core, and a measure of current passed through (e.g., a current carrying capacity of) the wire of an inductive element.

In certain instances, the transmitting an EM pulse sequence may include exciting a group of respective inductive elements at a same time to shape pulses of the EM pulse sequence by controlling one or more of transmission power, phase of a transmitted signal, and a transmission frequency. In certain instances, the transmission frequencies may be selected from an operating range of frequencies that may span an operating range of frequencies spans 0.1 Hertz (Hz) to 1000 Hz. In other instances, for example when, square wave shaped waveforms are used, spectral content may include frequencies over a greater range of frequencies.

Methods of the present disclosure may be referred to as through-tubing azimuthal defect evaluation. The inductive element design presented herein may be used on a through-tubing azimuthal defect evaluation tool. The inductive element may be a key part that directly influences the tool's performance on azimuthal detection and vertical resolution. The conformal space-filling coils discussed above improves both azimuthal and axial information that may be indicative of corrosion with high resolution. As such, tools described herein will greatly improve in pipe integrity inspection—in particular, the severity of damage can be more accurately estimated by knowing the azimuthal extent of a detected anomaly. The inductive element design from the conformal space-filling coils provides a competitive advantage over existing sensors/generators by providing a better area usage (higher packing density—meaning that more coil turns of a given wire gauge can be wrapped within the same space), signal to noise ratio, and flexibility.

Figure 10:
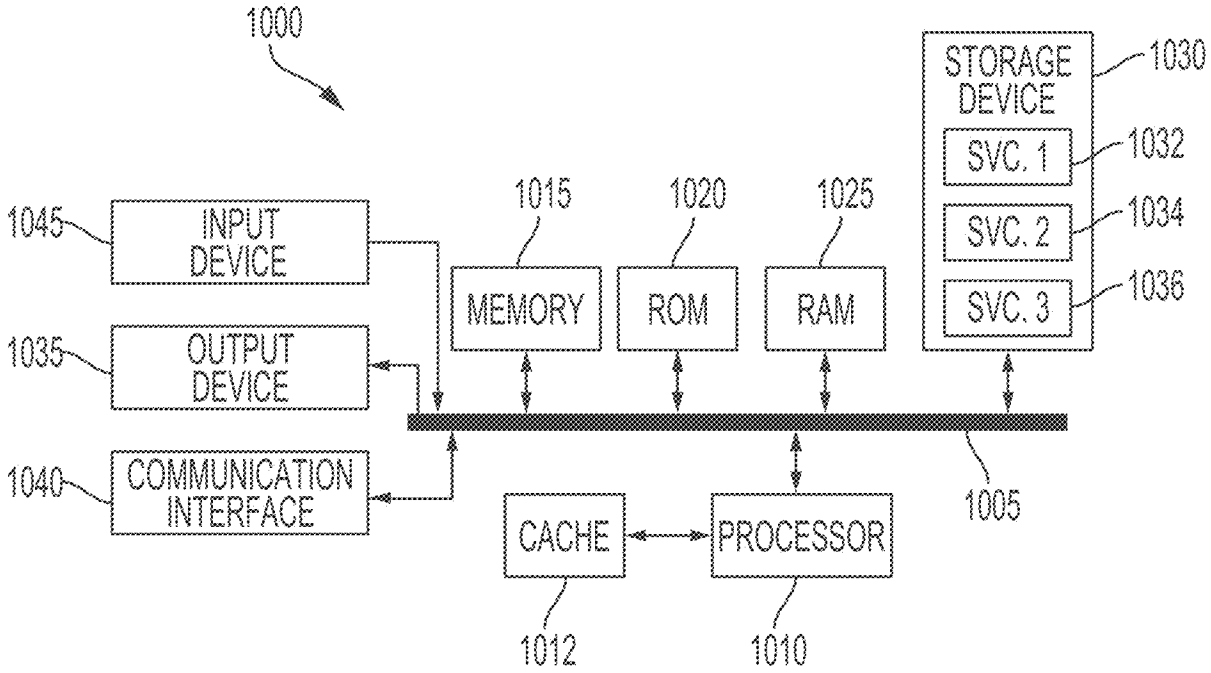
FIG. 10 illustrates an example computing device architecture which can be employed to perform various steps, methods, and techniques disclosed herein.

FIG. 10 illustrates an example computing device architecture 1000 which can be employed to perform any of the systems and techniques described herein. In some examples, the computing device architecture can be integrated with the electromagnetic imager tools described herein. Further, the computing device can be configured to implement the techniques of controlling borehole image blending through machine learning described herein.

The components of the computing device architecture 1000 are shown in electrical communication with each other using a connection 1005, such as a bus. The example computing device architecture 1000 includes a processing unit (CPU or processor) 1010 and a computing device connection 1005 that couples various computing device components including the computing device memory 1015, such as read only memory (ROM) 1020 and random access memory (RAM) 1025, to the processor 1010.

The computing device architecture 1000 can include a cache of high-speed memory connected directly with, in close proximity to, or integrated as part of the processor 1010. The computing device architecture 1000 can copy data from the memory 1015 and/or the storage device 1030 to the cache 1012 for quick access by the processor 1010. In this way, the cache can provide a performance boost that avoids processor 1010 delays while waiting for data. These and other modules can control or be configured to control the processor 1010 to perform various actions. Other computing device memory 1015 may be available for use as well. The memory 1015 can include multiple different types of memory with different performance characteristics. The processor 1010 can include any general purpose processor and a hardware or software service, such as service 1 1032, service 2 1034, and service 3 1036 stored in storage device 1030, configured to control the processor 1010 as well as a special-purpose processor where software instructions are incorporated into the processor design. The processor 1010 may be a self-contained system, containing multiple cores or processors, a bus, memory controller, cache, etc. A multi-core processor may be symmetric or asymmetric.

To enable user interaction with the computing device architecture 1000, an input device 1045 can represent any number of input mechanisms, such as a microphone for speech, a touch-sensitive screen for gesture or graphical input, keyboard, mouse, motion input, speech and so forth. An output device 1035 can also be one or more of a number of output mechanisms known to those of skill in the art, such as a display, projector, television, speaker device, etc. In some instances, multimodal computing devices can enable a user to provide multiple types of input to communicate with the computing device architecture 1000. The communications interface 1040 can generally govern and manage the user input and computing device output. There is no restriction on operating on any particular hardware arrangement and therefore the basic features here may easily be substituted for improved hardware or firmware arrangements as they are developed.

Storage device 1030 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 1025, read only memory (ROM) 1020, and hybrids thereof. The storage device 1030 can include services 1032, 1034, 1036 for controlling the processor 1010. Other hardware or software modules are contemplated. The storage device 1030 can be connected to the computing device connection 1005. In one aspect, a hardware module that performs a particular function can include the software component stored in a computer-readable medium in connection with the necessary hardware components, such as the processor 1010, connection 1005, output device 1035, and so forth, to carry out the function.

For clarity of explanation, in some instances the present technology may be presented as including individual functional blocks including functional blocks comprising devices, device components, steps or routines in a method implemented in software, or combinations of hardware and software.

In some instances, the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific examples and aspects thereof, but those skilled in the art will recognize that the application is not limited thereto. Thus, while illustrative examples and aspects of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, examples and aspects of the systems and techniques described herein can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate examples, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Methods and apparatus of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Such methods may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Claim language or other language in the disclosure reciting "at least one of" a set and/or "one or more" of a set indicates that one member of the set or multiple members of the set (in any combination) satisfy the claim. For example, claim language reciting "at least one of A and B" or "at least one of A or B" means A, B, or A and B. In another example, claim language reciting "at least one of A, B, and C" or "at least one of A, B, or C" means A, B, C, or A and B, or A and C, or B and C, or A and B and C. The language "at least one of" a set and/or "one or more" of a set does not limit the set to the items listed in the set. For example, claim language reciting "at least one of A and B" or "at least one of A or B" can mean A, B, or A and B, and can additionally include items not listed in the set of A and B.

Illustrative statements of the present disclosure include:

Statement 1: An apparatus comprising: a plurality of inductive elements distributed azimuthally relative to a center line of the apparatus, wherein: each respective inductive element of the plurality of inductive elements includes a respective core, wherein: each of the respective inductive elements of the plurality of inductive elements includes wire wrappings that conform to a trapezoidal form factor, and the trapezoidal form factor includes a cross-sectional area that increases with a height dimension of the respective inductive elements. This apparatus may also include contacts that electrically connect ends of the wire wrappings to circuits associated with the apparatus.

Statement 2: The apparatus of statement 1, wherein a first cross-sectional area of the trapezoidal form factor includes a different number of wrappings of the wire wrappings than a second cross-sectional area of the trapezoidal form factor.

Statement 3: The apparatus of statement 2, wherein a core of each of the respective inductive elements has a cross-sectional area that is maintained along at least a portion of the height dimension of the respective inductive elements.

Statement 4: The apparatus of any of statements 1 through 3, wherein each of the respective inductive elements have an axis that is perpendicular to the center line of the apparatus.

Statement 5: The apparatus of any of statements 1 through 4, wherein each of the respective inductive elements are abutted against each other in a circular configuration.

Statement 6: The apparatus of any of statements 1 through 5, wherein cores of each of the respective inductive elements have a magnetic permeability that is less than a threshold value when a deployment rule requires that the cores be non-ferromagnetic.

Statement 7: The apparatus of any of statements 1 through 6, wherein cores of each of the respective inductive elements have a magnetic permeability that is greater than a threshold value when a deployment rule requires that the cores be ferromagnetic.

Statement 8: The apparatus of statements 7, wherein the ferromagnetic cores includes laminations of steel strips and a number of the steel strips associated with the trapezoidal from factor is identified by a core length divided by a thickness of the steel strips.

Statement 9: The apparatus of any of statements 1 through 8, wherein each of the respective inductive elements are modules that physically attach the contacts that electrically connect the ends of the wire wrappings to the circuits associated with the apparatus.

Statement 10: The apparatus of any of statements 1 through 9, wherein each of the respective cores have a non-uniform cross-sectional area based on a shape associated with the trapezoidal form factor.

Statement 11: The apparatus of any of statements 1 through 10, wherein a dimension of each of the respective cores located at a distance further from the center line is proportional to a diameter of a circle formed when each of the plurality of inductive elements are abutted in a side-to-side configuration.

Statement 12: The apparatus of statement 11, wherein diameter of the circle corresponds to an inner diameter of an enclosure where the plurality of inductive elements are located.

Statement 13: The apparatus of any of statements 1 through 12, wherein a gauge of wire of the wire wrappings is selected according to a rule that associates electromagnetic field strength with a number of turns and a current carrying capacity of the wire.

Statement 14: A method comprising: a. deploying sensing tool in a wellbore when the sensing tool includes a plurality of inductive elements distributed azimuthally relative to a center line of the sensing tool; and b. transmitting one or more electromagnetic (EM) signals from the sensing tool based on each of the respective inductive elements of the plurality of inductive elements including wire wrappings that conform to a trapezoidal form factor when the trapezoidal form factor includes a cross-sectional area that increases with a height of the respective inductive elements.

Statement 15: The method of statement 14, wherein the transmission of the one or more EM signals includes exciting each of the respective inductive elements of the plurality of inductive elements one at a time.

Statement 16: The method of any of statements 14 or 15, wherein the transmission of the one or more EM signals includes exciting a group of the respective inductive elements at a same time to shape emissions of EM energy by controlling one or more of transmission power, phase of a transmitted signal, and a transmission frequency.

Statement 17: The method of statement 16, wherein the transmission frequencies are selected from an operating range of frequencies.

Statement 18: The method of any of statements 16 or 17, wherein the operating range of frequencies are selected based on a type of EM signal.

Statement 19: The method of any of statements 14 through 18, further comprising providing sensed signals associated with the one or more transmitted EM signals to circuits coupled to the sensing tool.

Statement 20: The method of statement 19, wherein operation of the circuits coupled to the sensing tool provide an indication of corrosion associated with metal located in the wellbore.

What is claimed is:

1. An apparatus comprising:

a plurality of inductive elements distributed azimuthally relative to a center line of the apparatus, wherein:

each respective inductive element of the plurality of inductive elements includes a respective core, wherein:

each of the respective inductive elements of the plurality of inductive elements includes wire wrappings that conform to a trapezoidal form factor;

the trapezoidal form factor includes a cross-sectional area that has a first width at a top of the respective core; and the cross-sectional area decreases in width toward a bottom of the respective core; and contacts that electrically connect ends of the wire wrappings to circuits associated with the apparatus.

2. The apparatus of claim 1, wherein a first cross-sectional area of the trapezoidal form factor includes a different number of wrappings of the wire wrappings than a second cross-sectional area of the trapezoidal form factor.

3. The apparatus of claim 2, wherein a core of each of the respective inductive elements has a cross-sectional area that is maintained along at least a portion of a height dimension of the respective inductive elements.

4. The apparatus of claim 1, wherein each of the respective inductive elements have an axis that is perpendicular to the center line of the apparatus.

5. The apparatus of claim 4, wherein each of the respective inductive elements are abutted against each other in a circular configuration.

6. The apparatus of claim 1, wherein cores of each of the respective inductive elements have a magnetic permeability that is less than a threshold value when a deployment rule requires that the cores be non-ferromagnetic.

7. The apparatus of claim 1, wherein cores of each of the respective inductive elements have a magnetic permeability that is greater than a threshold value when a deployment rule requires that the cores be ferromagnetic.

8. The apparatus of claim 7, wherein the ferromagnetic cores includes laminations of steel strips and a number of the steel strips associated with the trapezoidal form factor is identified by a core length divided by a thickness of the steel strips.

9. The apparatus of claim 1, wherein each of the respective inductive elements are modules that physically attach the contacts that electrically connect the ends of the wire wrappings to the circuits associated with the apparatus.

10. The apparatus of claim 1, wherein each of the respective cores have a non-uniform cross-sectional area based on a shape associated with the trapezoidal form factor.

11. The apparatus of claim 1, wherein a dimension of each of the respective cores located at a distance further from the center line is proportional to a diameter of a circle formed when each of the plurality of inductive elements are abutted in a side-to-side configuration.

12. The apparatus of claim 11, wherein diameter of the circle corresponds to an inner diameter of an enclosure where the plurality of inductive elements are located.

13. The apparatus of claim 1, wherein a gauge of wire of the wire wrappings is selected according to a rule that associates electromagnetic field strength with a number of turns and a current carrying capacity of the wire.

14. A method comprising:

deploying sensing tool in a wellbore when the sensing tool includes a plurality of inductive elements distributed azimuthally relative to a center line of the sensing tool; and transmitting one or more electromagnetic (EM) signals from the sensing tool based on each of the respective inductive elements of the plurality of inductive elements including wire wrappings that conform to a trapezoidal form factor when the trapezoidal form factor includes a cross-sectional area that has a first width at a top of the cross-sectional area, wherein the cross-sectional area decreases in width toward a bottom of the cross-sectional area.

15. The method of claim 14, wherein the transmission of the one or more EM signals includes exciting each of the respective inductive elements of the plurality of inductive elements one at a time.

16. The method of claim 14, wherein the transmission of the one or more EM signals includes exciting a group of the respective inductive elements at a same time to shape emissions of EM energy by controlling one or more of transmission power, phase of a transmitted signal, and a transmission frequency.

17. The method of claim 16, wherein the transmission frequencies are selected from an operating range of frequencies.

18. The method of claim 17, wherein the operating range of frequencies are selected based on a type of EM signal.

19. The method of claim 14, further comprising:

providing sensed signals associated with the one or more transmitted EM signals to circuits coupled to the sensing tool.

20. The method of claim 19, wherein operation of the circuits coupled to the sensing tool provide an indication of corrosion associated with metal located in the wellbore.

* * * * *